United States Patent [19]

Yagi et al.

[11] Patent Number: 4,625,493

[45] Date of Patent: Dec. 2, 1986

[54] APPARATUS FOR WRAPPING THE END SURFACE OF CYLINDRICAL OBJECT

[75] Inventors: Yoshio Yagi; Toshihiko Kondo; Norio Matsubara; Shoichiro Miyazaki; Atsumi Seya, all of Kitakyushu; Akira Matsunami; Keizo Fujiwara, both of Kimitsu, all of Japan

[73] Assignees: Yuwa Sangyo Kabushiki Kaisha; Nippon Steel Corporation, both of Tokyo, Japan

[21] Appl. No.: 813,274

[22] Filed: Dec. 24, 1985

[30] Foreign Application Priority Data

Dec. 25, 1984 [JP] Japan ..... 59-272089

[51] Int. Cl.[4] ..... B65B 7/14

[52] U.S. Cl. ..... 53/378; 53/204; 53/211; 53/380

[58] Field of Search ..... 53/204, 211, 378, 380

[56] References Cited

U.S. PATENT DOCUMENTS

| | | | |
|---|---|---|---|
| 2,746,224 | 5/1956 | Wollett . | |
| 3,200,564 | 8/1965 | Lagesse . | |
| 3,296,772 | 1/1967 | Barker . | |
| 4,095,395 | 6/1978 | Goldstein . | |
| 4,184,307 | 1/1980 | Kataoka | 53/380 |
| 4,524,562 | 6/1985 | Yagi | 53/380 X |

FOREIGN PATENT DOCUMENTS

| | | | |
|---|---|---|---|
| 2417563 | 10/1975 | Fed. Rep. of Germany | 53/211 |
| 49189 | 4/1977 | Japan | 53/204 |
| 52-49189 | 4/1977 | Japan . | |
| 52-19149 | 5/1977 | Japan . | |

*Primary Examiner*—John Sipos

*Attorney, Agent, or Firm*—Wenderoth, Lind & Ponack

[57] ABSTRACT

Apparatus for wrapping the end surface of a cylindrical object having an apparatus fixing frame placed on a base via an ultra low friction sliding mechanism, a back pressure $P_2$ suitable for the kind of wrapping paper being imposed on the wrapping paper and the free end of the projecting portion of the wrapping paper being gripped at plural points in the circumferential direction so as to draw the frame toward the axial center of the cylindrical coil whereby the free end of the projecting portion of the wrapping paper is constrained by tension produced on the projecting wrapping paper throughout the folding operation with the result that regular pleats are formed to assure an attractive transport package.

3 Claims, 24 Drawing Figures

APPARATUS FOR WRAPPING THE END SURFACE OF CYLINDRICAL OBJECT

BACKGROUND OF THE INVENTION

The present invention relates to an apparatus for wrapping the end surface of a cylindrical object, for example, a cylindrically shaped coil of steel strip (referred to as a "coil" hereinafter) in order to automate the work of folding a wrapping paper on the end surface thereof and save labor.

DESCRIPTION OF THE PRIOR ART

For the wrapping of a coil with a wrapping paper wider than the width of the coil, various methods for folding the paper edges projecting from both ends of the coil have been heretofore proposed. For instance, Japan Examined Patent Application (referred to as "Kokoku Sho" hereinafter) No. Sho 52-19149 proposes that the projecting paper edge be gripped at plural points in the circumferential direction, and be folded together toward the center of the end surface of the coil as the whole apparatus moves toward the end surface.

Japan Unexamined Patent Application (referred to as "Kokai Sho" hereinafter) No. Sho 52-49189 proposes as follows: the projecting paper is clamped at the innermost portions from the inner and outer sides by a long arm with concave and convex rollers at its tip and the paper is folded together in the central direction of the end surface of the coil, whereupon sliding takes place to form pleats. U.S. Pat. No. 2,746,224 proposes a wrapping machine, U.S. Pat. No. 4,095,395 proposes a self-guiding stretch machine, U.S. Pat. No. 4,184,307 proposes a device for wrapping the ends of rolls, U.S. Pat. No. 3,200,564 proposes a device for folding the end of a cylindrical wrapping, and U.S. Pat. No. 3,296,772 also proposes wrapping of cylindrical rolls.

SUMMARY OF THE INVENTION

It is the principal object of the invention to overcome the problem of wrapping steel sheet coils completely with a wrapping sheet material, and to provide an apparatus for wrapping various steel coils of different diameters with a wrapping material, and folding the projecting portions of the wrapping material onto end surfaces of different diameters.

The present invention provides an apparatus for wrapping a heavy coil with a wrapping material wherein the peripheral surface and end surfaces of the coil are quickly and precisely wrapped with the wrapping material with a neat, attractive folded end face at either end.

BRIEF EXPLANATION OF THE DRAWINGS

Other and further objects of the invention will become apparent from the following detailed description with reference to the drawings, in which:

FIG. 8-1 is a front view of a support arm fixing disc of this invention;

FIG. 8-2 is a partial enlarged view of the part A of FIG. 8-1;

FIG. 8-3 is a partial enlarged view of the part B of FIG. 8-1;

FIG. 12-1 is a side view of the grip means of this invention;

FIG. 12-2 and FIG. 12-3 are the explanatory views of the grip means for gripping a wrapping paper of this invention;

FIG. 14-B is a front view of FIG. 14-A;

FIG. 14-C is a partial view of FIG. 14-A;

FIG. 15-(f-1) shows how it is fixed by a tape;

FIG. 15-(f-2) shows how it is fixed by an eye trumpet; and

FIG. 15-(f-3) shows how it is fixed by an adhesive.

DETAILED DESCRIPTION OF THE INVENTION

Through their experience, the inventors of the present invention came to perceive that the constraint ratio of the free projecting portion of a wrapping paper should be as large as possible in the course of folding the wrapping paper in order to regularly generate plural pleats and fold them in a regular and orderly manner.

On the basis of the above concept, the present inventors announced a method and apparatus for folding the projecting portion of a wrapping paper by restraining its outer side with a pusher plate and its inner side by a pleat forming rod in U.S. Pat. No. 4,524,562.

With the aim of reducing equipment cost and shortening the work cycle time, the present invention proposes an apparatus for producing plural pleats regularly by restraining the projecting portion of the wrapping paper with tension alone.

In accordance with the present invention, a movable base is placed on a fixed frame, and an apparatus is mounted on the frame by means of an ultra low friction sliding mechanism and also is provided with a device for adjusting the frame in the direction of a coil axial center, which device comprises a thread mechanism and a counter balance cylinder.

In this invention, since the friction between the apparatus fixing frame and the movable base is exceedingly small, e.g. 1/1000–2/1000, the whole apparatus fixing frame is attracted in the direction of the end surface of a coil by a relatively small tension occurring at the free end of the projecting portion of the wrapping paper. During the attraction, the free end of the projecting portion of the wrapping paper is restrained by the tension to produce a plurality of regular pleats.

The present invention will now be described in detail with reference to the drawings.

Figure 1:
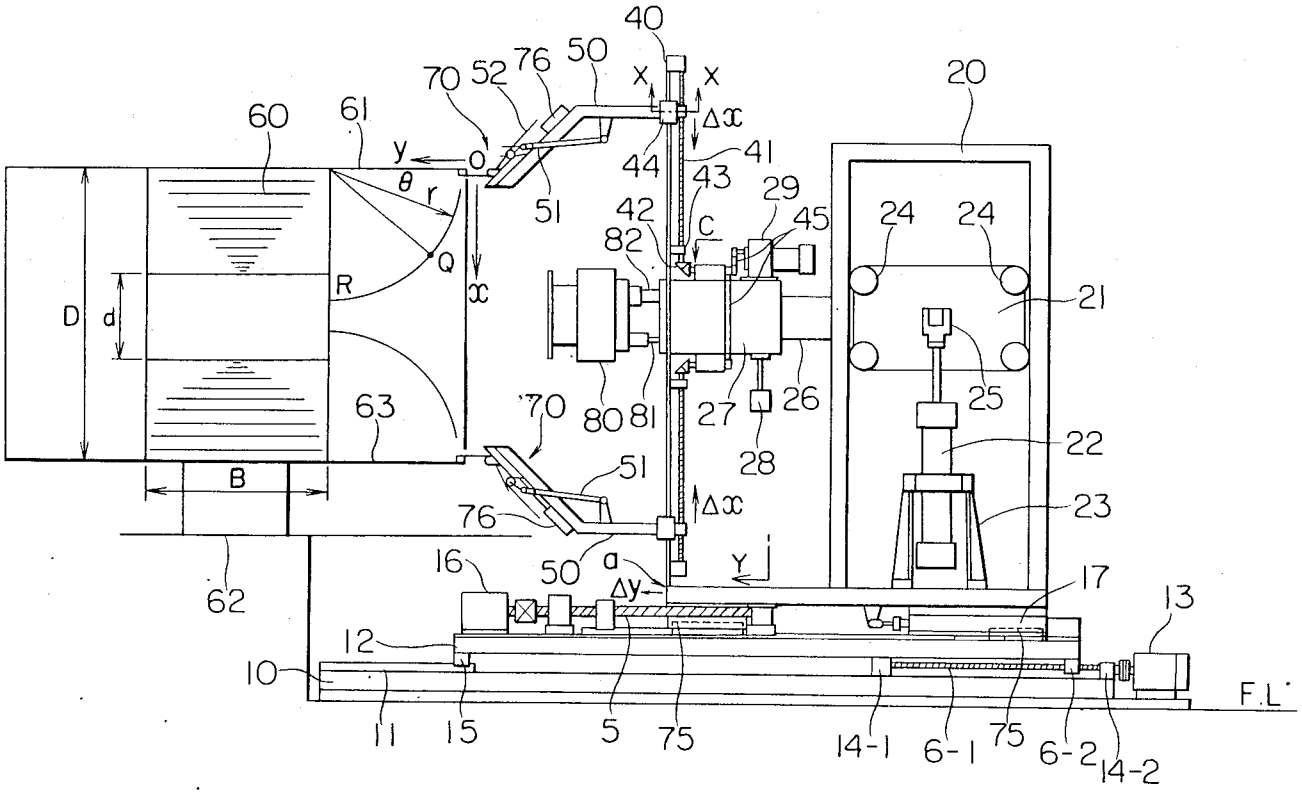
FIG. 1 is an overall side view of the present invention.

In FIG. 1, an apparatus for wrapping the end surface of a coil is provided face to face with one end surface of the coil 60 placed on a coil stand 62, and another apparatus (not shown) is similarly provided facing the other end surface of the coil. For convenience, only one apparatus is described.

As shown in FIG. 1, a movable base 12 is provided on an immovable base 10 on the floor so as to face one end surface of the coil and be movable in the axial direction of the coil. The movable base 12 can be moved horizontally in the direction of the coil end surface via a motor 13, a driving screw 6-1, a screw bracket 6-2, and a bearing 14, the end of the base remote from the motor 13 having a slide bracket 15 sliding on a guide rail 11. By this mechanism, a device for gripping the projecting portion of the wrapping paper can be set at an initial position.

Figure 2:
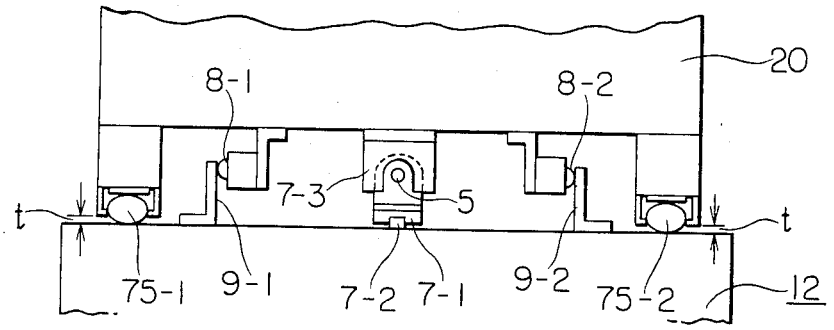
FIG. 2 is a front view of the part a of FIG. 1.
Figure 3:
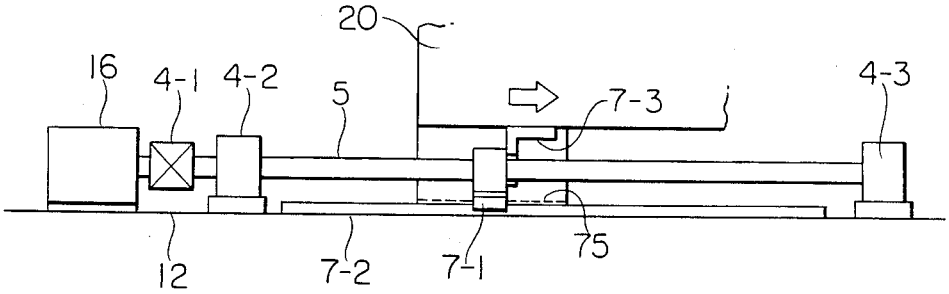
FIG. 3 is a side view of the part a of FIG. 1.
Figure 4:
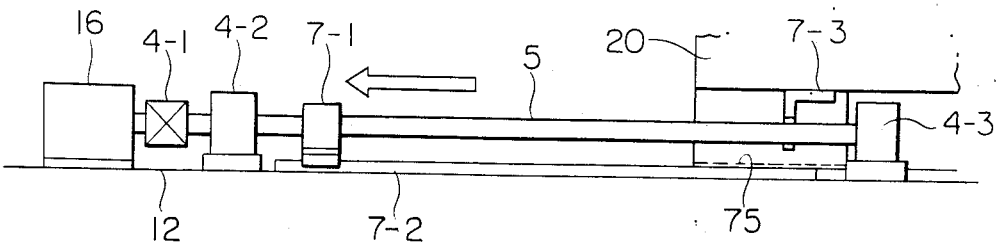
FIG. 4 is also a side view of the part a of FIG. 1.

As shown in FIGS. 2–4, an apparatus fixing frame (referred to as a "frame" hereinafter) 20 is placed on the movable base 12 via an ultra low friction sliding mechanism to be described later. The position of the frame 20 can be adjusted in the horizontal direction via a motor 16, a coupling 4-1, bearings 4-2, 4-3, a driving screw 5, a slide bracket 7-1 through which screw 5 is threaded and which is guided along a guide rail 7-2, on a bracket 7-3, counter balanced by a hydraulic cylinder shown in FIG. 7. The frame 20 is provided with a lifting frame 21 comprising guide rollers 24 and a relevant guide rail, an operating cylinder 22, its stand 23 and a cylinder rod member 25. To the coil end side of the lifting frame 21, a tubular member 26 is fixed and projects toward the coil end and a slidable tubular member 27 is mounted rotatably therearound by means of supporting rollers 27-1, a bracket 26-1, a universal joint 26-2 and an operating cylinder 28 as shown in FIGS. 8-1 and 8-3.

As illustrated in FIGS. 1 and 8 through 11, the slidable tubular member 27 is provided with a disc 40, in which plurality of rectangular openings 49 are provided in radial direction thereof and guide rails 48-1 and 48-2 are fixed along the edges of these openings. The base portion of an arm 50, to the opposite end of which a gripping device 70 for wrapping paper and a pusher plate 52 are attached, is provided with a wheel box 44 having guide rollers 46-1 to 46-6 and 46-1' to 46-6' thereon rolling of the rails and a thread box 47 on the wheel box 44.

A driving means comprising a motor 29 driving a chain 45 engaging a plurality of level gears 42, one bevel gear 42 for each arm 50, and a driving screw 41 for each arm 50 driven by a level gear 42 and which engages with the aforementioned thread box 47, is so arranged that a plurality of aforementioned arms 50 move simultaneously on the disc 40 in radial direction thereof. In FIGS. 2, 3 and 4, the slide bracket 7-1 is engaged with the threads of the driving screw 5 and slides on the guide rail 7-2. Ball guides 8-1 and 8-2 and fixed guides 9-1 and 9-2, the coupling 4-1, and bearings 4-2 and 4-3 are shown.

The ultra low friction sliding mechanism (referred to as a "friction bearing" hereinafter) 75-1 and 75-2 indicated in FIG. 2 will now be described.

The friction bearing is one whose friction coefficient is in the range of 1/1000–2/1000. The air bearing systems shown in FIGS. 5 and in 2 and 6 meet this limitation, but a known ball slide unit or electromagnetic lift system can also be used.

Figure 5:
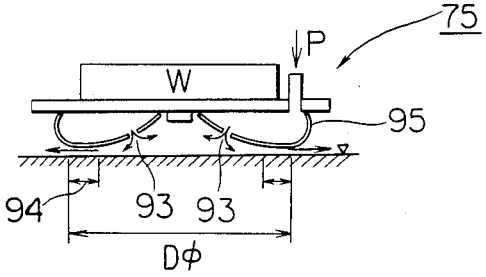
FIG. 5 is an explanatory view of an air bearing.

The air bearing 75 in FIG. 5 is provided with a flexible film 95 having an air feed opening P and also with a small hole 93. The support capacity W is determined by the product of the area surrounded by a diameter D by the air pressure stored in the flexible film.

Figure 6:
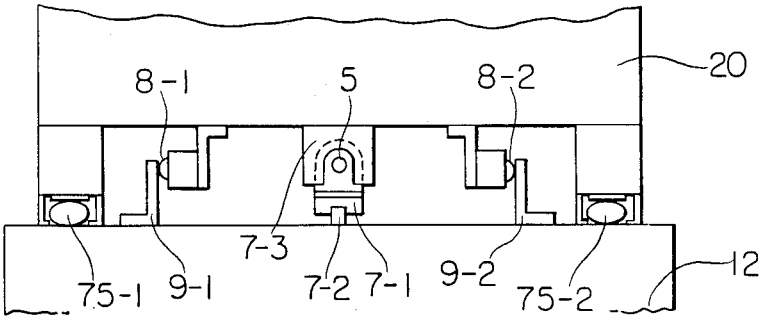
FIG. 6 is an explanatory view showing how to apply the air bearing of the invention.

Operation of the air bearings 75-1 and 75-2 of FIGS. 2 and 6 causes the frame 20 to float up easily from the rest position in FIG. 6 to the floating position in FIG. 2 guided by the ball guides 8-1 and 8-2 so that a clearance t is produced between the movable base 12 and the frame 20.

Figure 7:
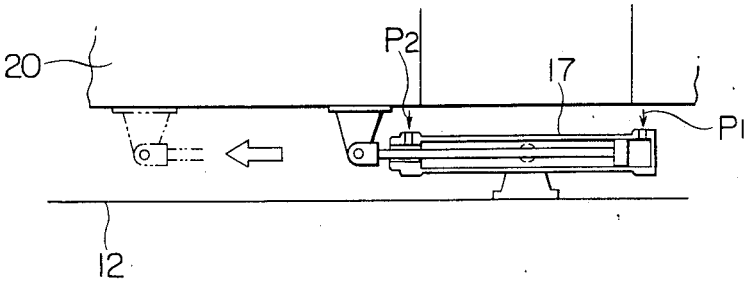
FIG. 7 is a partial side view of FIG. 1.
Figures 1, 8:
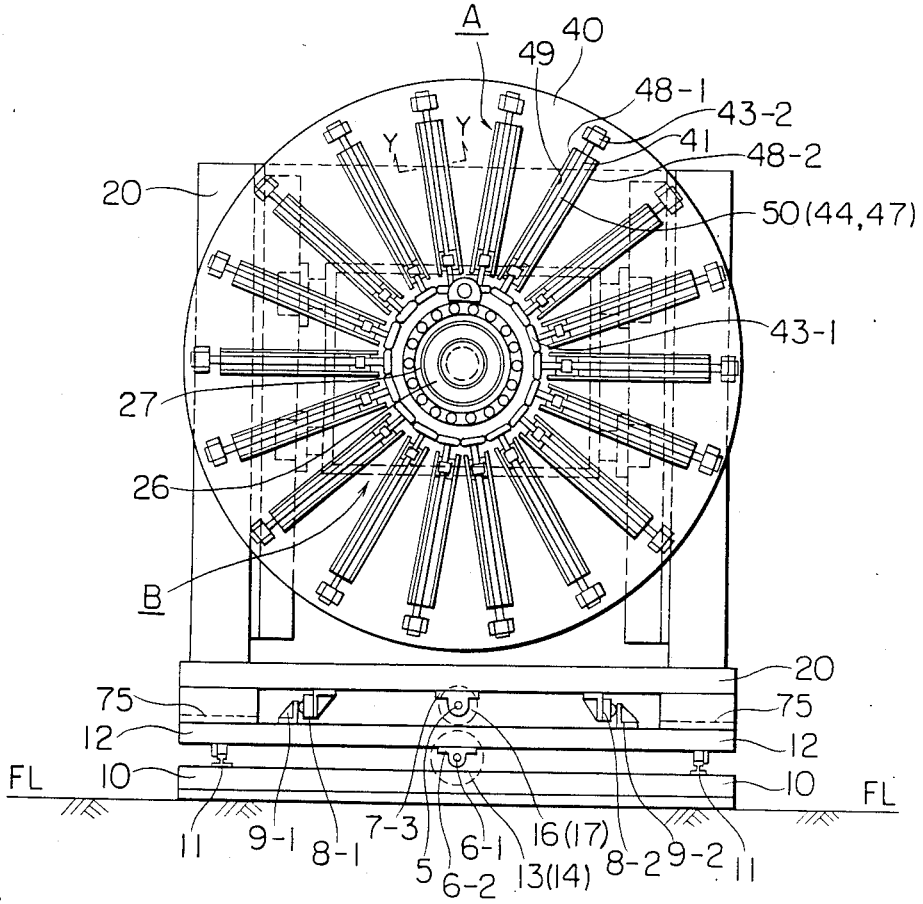
Figures 2, 8:
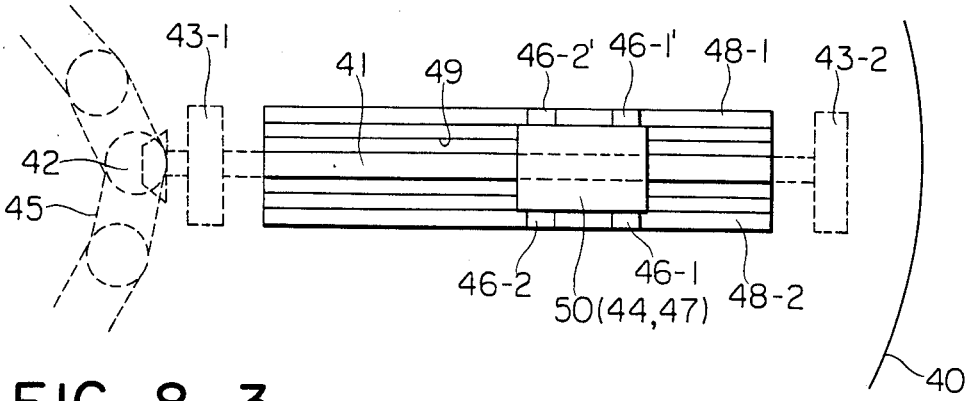
Figures 3, 8:
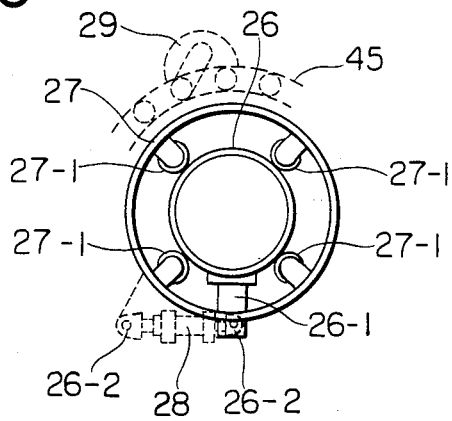

In FIG. 7, a hydraulic cylinder (referred to as a "cylinder" hereinafter) 17 works as a counter balance ($P_1$) when the frame 20 is made to move in the right hand direction by the motor 16 to return to its initial position (see FIG. 3) after the completion of the folding action of the wrapping paper, and also supplies a back pressure ($P_2$) which gives the required tension to the wrapping paper during the folding action of the wrapping paper.

When setting of the initial position of the frame 20 in the horizontal direction is finished, the motor 16 is reversed to return the slide bracket 7-1 with the screw 5 to the position indicated in FIG. 4. Thus, in the course of folding the projecting portion of the wrapping paper, the frame 20 moves easily in the left hand direction of FIGS. 3–4 drawn by the tension arising in the wrapping paper.

The tubular member 26 of this invention is provided with an insert head 80 comprising a coil bore pressure device and a taping device or an eye trumpet fixing device which are not shown in detail. The head 80 is traversable in the direction of the coil axial center line by a cylinder (not shown), a support arm 82 and a guide bar 81.

FIGS. 8–11 show how the support arm 50 is attached to the disc 40.

Figure 10:
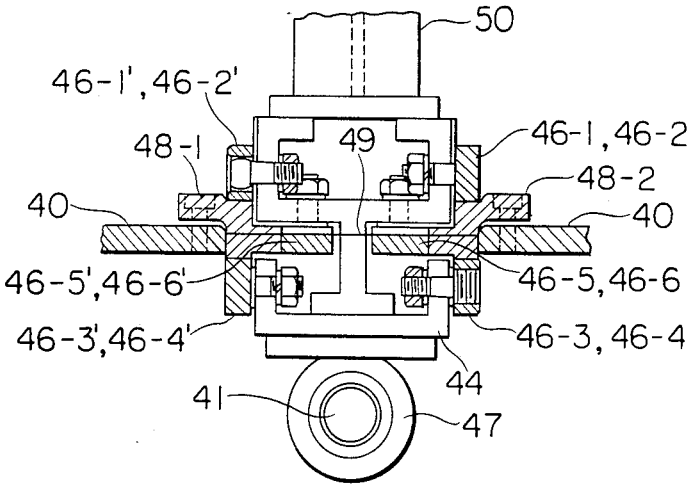
FIG. 10 is a view taken along line X—X of FIG. 1 and a view taken along line Y—Y of FIG. 8-1.

As shown in FIG. 8 and FIG. 10, the disc 40 is provided with the plurality of openings 49 in the radial direction, and each opening has a length of about one half the radius of the disc. In this embodiment, there are 18 holes spaced at intervals of 20°, but it is not limited to this arrangement.

Figure 9:
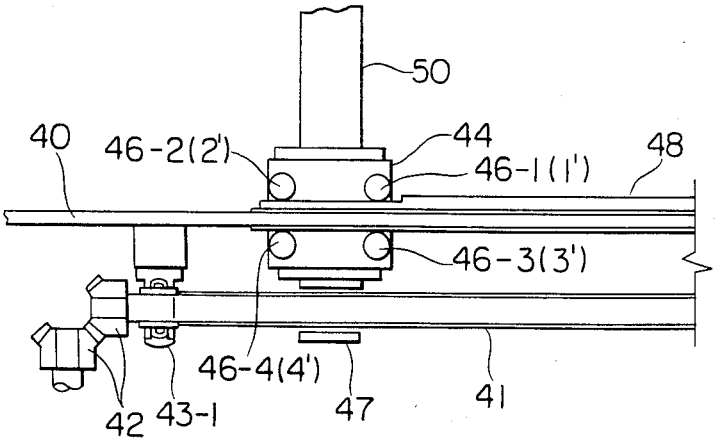
FIG. 9 is a partial side view of the part C of FIG. 1.
Figure 11:
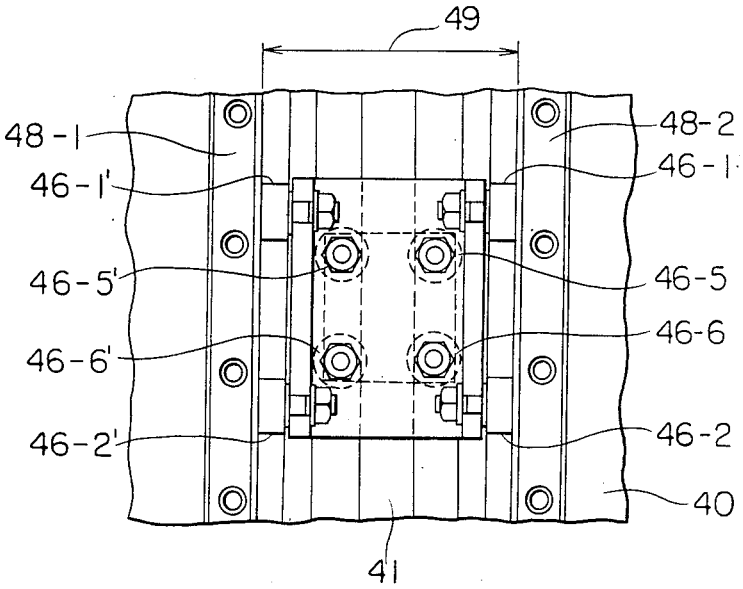
FIG. 11 is a plan view of FIG. 10.

As illustrated in FIGS. 9–11, the opening 49 is provided with the guide rails 48-1 and 48-2 at its border. The wheel box 44 comprising guide rollers 46-1-6, and 46-1'-6' is provided with an internal thread box 47. By the rotation of the arm opening and closing screw 41 in mesh with the thread box 47, the support arm 50 moves outwardly and inwardly in the radial direction along the disc 40 via the guide rollers and the guide rails.

Figures 1, 12:
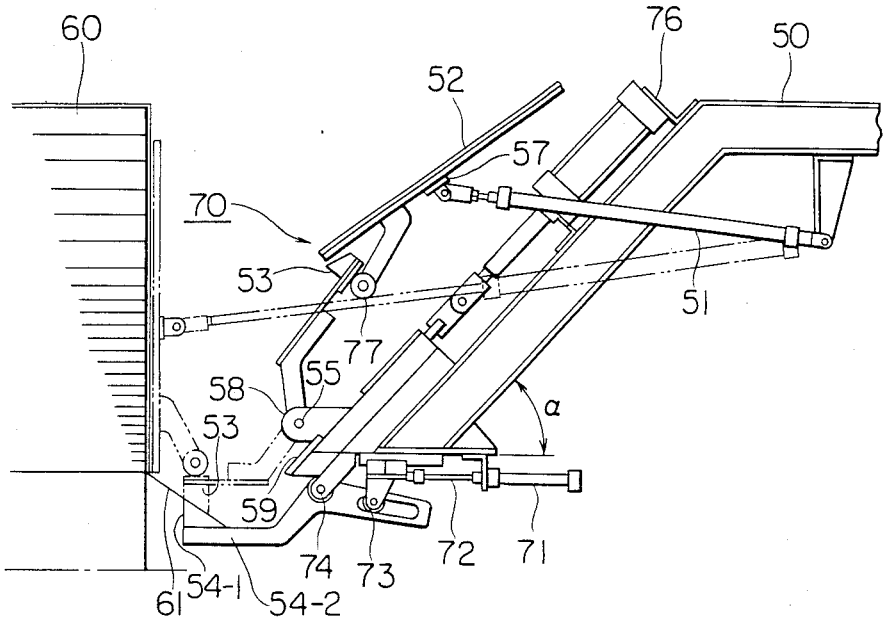
Figures 2, 12:
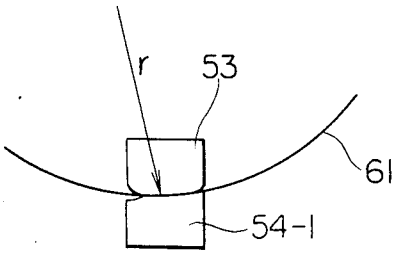
Figures 3, 12:
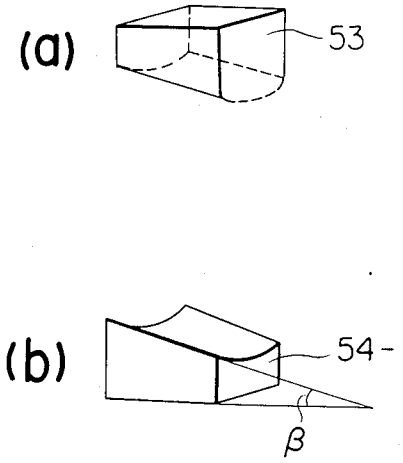

As depicted in FIG. 12, the foremost end of each support arm 50 has a grip means 70 for the wrapping paper and also a pusher plate 52. Therefore the grip means 70 grips the projecting portion of the wrapping paper at plural points in the circumferential direction, the plurality of the supporting arms 50 are caused to move toward the center of the coil end surface along the surface of the disc 40 by the driving mechanism comprising a motor 29 and associated elements, and at the same time the frame 20 is drawn toward the coil end surface while the said frame is supported on the moving base 12 by means of the air bearing, the friction therebetween being extremely small. In other words, a plurality of pleats are produced in the direction perpendicular to the end surface of the coil at the same time that the frame 20 is drawn toward the coil end surface. Thereafter the gripping of the wrapping paper is released by the cylinder 71, and the pleats are pushed by the pusher plate 52 actuated by a cylinder 51, then the pleats are flattened down by rotating the disc 40 by rotating the slidable member 27 by the cylinder 28.

Figure 13:
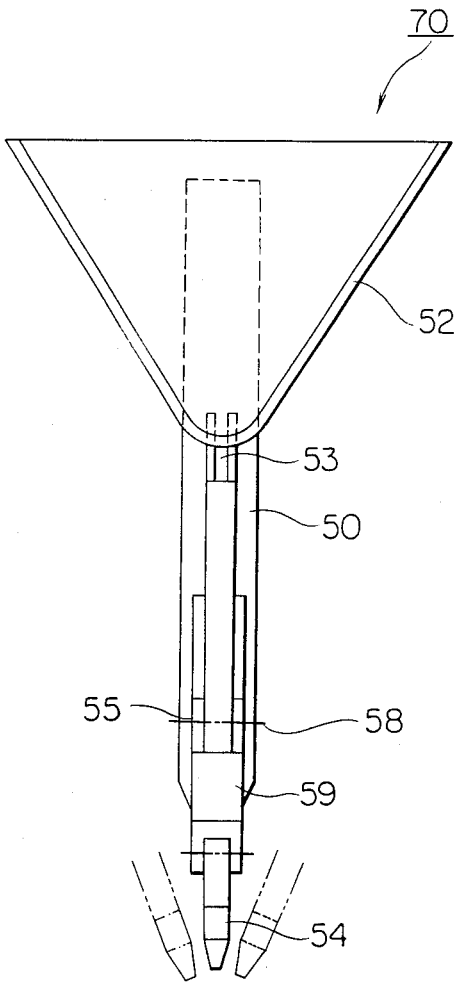
FIG. 13 is a partial front view of FIG. 12-1.

FIGS. 12–13 show the grip means 70 attached to the foremost end of the support arm in detail. In these drawings, to prevent reverse folding of the wrapping paper, the upper member 53 and lower member 54-1 of the grip means 70 catch the projecting portion of the wrapping paper somewhat inside its edge with a suitable oblique angle in the direction of folding relative to the coil axial center so as to grip the free end of the wrapping paper. The above oblique angle is preferably selected tube in the range of 30° to 60° in accordance with the tensile strength of the wrapping material.

A suitable curvature on the gripping portions of the outer and inner gripping members in the coil circumferential direction facilitates the producing of pleats during the folding. The preferred curvature is $r \approx 30 \sim 50$ mm as shown in FIGS. 12-2 and 12-3. The outer member 53, to which a pusher plate 52 is connected by hinge 77, is hinged to a support arm 58 on a rack 59 by a pinion 55 so that the outer gripping element 53 is turned down to the inner gripping element 54 to grip the wrapping paper therebetween by cylinder 51 hinged at 57 to plate 52. Since the wrapping paper wraps the coil with both end surfaces projecting beyond the edges of the coil, and it is unavoidable that the projecting portion of the wrapping paper becomes so long that it hangs down to a degree if the coil diameter is too large. Therefore, to easily grip the projecting portion of the wrapping paper, the foremost end of the support arm 50 is made oblique at an angle of 45° relative to the axis of the coil as shown in FIG. 12. To facilitate and to ensure each gripping action, open grip means is inserted into the projecting portion of the wrapping paper, and then the outer member is turned down against the inner member to grip the wrapping paper therebetween.

In FIG. 12, the inner member of the grip means is released from gripping by means of a cylinder 71 via a guide 72, a link mechanism 73, a fulcrum 74 and arm 54-2 which holds the inner member 54-1. The pusher plate 52 is connected to the outer member 53 by a hinge 77, and is pivotally mounted on the rod of the cylinder 51 to push the coil end surface.

When the grip means for the projecting portion of the wrapping paper needs adjustment, the outer member 53 and the inner member 54 should be somewhat slid with the gripped wrapping paper. Hence a material with suitable friction coefficient should be selected. MC nylon is preferred.

The hydraulic cylinder 28 shown in FIG. 1 is mounted on the bracket 26-1 attached to the tubular member 26, and connected with the slidable tubular member 27 by the universal joint 26-2. Namely, in the condition where the frame 20 is supported on a friction bearing (for instance, an air bearing), when the motor 29 (FIG. 1) starts to make the support arm 50 slide from the outer circumference of the coil to its axial center in a squeezing manner on the face of the disc 40 along the guide rails provided in the radial direction, the grip device of the support arm 50 grips the projecting portion of the wrapping paper of the coil on its circumference.

For an amount of movement $\Delta_x$ of the support arm 50, the frame 20 is drawn on the order of $\Delta_y$ toward the end surface of the coil by tension arising in the projecting portion of the wrapping paper on the movable machine base. In this case, the back pressure $P_2$ which depends on the wrapping paper is given to the cylinder 17.

Further, with the centripetal motion of the frame 20, the back pressure $P_2$ is automatically controlled depending on a preset mode in accordance with the external shape and size of the coil relative to a horizontal component of force by which the frame 20 is drawn to the end surface of the coil.

Therefore, throughout the course of the centripetal motion of the support arm 50 along the disc 40 in the radial direction the projecting portion of the wrapping paper is folded up to the end surface of the coil under a constrained state wherein it is at all times subjected to a suitable tension. Accordingly, plural pleats are regularly produced in the direction perpendicular to the end surface of the coil.

When different kinds of wrapping materials are used, the back pressure $P_2$ of the cylinder 17 of FIG. 7 can be adjusted depending on the kind of materials.

The operation of the present invention will now be explained.

A coil 60 (outside diameter D, inside diameter d, and width B) is wrapped with a wrapping paper having a wider width than the width B, and the end portion of the wrapping paper projects from both ends of the coil. The length of the projecting portion is made larger than the coil thickness $\frac{1}{2}$ (D-d), and the coil is placed on a coil stand 62.

Then, the air bearing, such as bearing 75 or 75-1, 75-2, is operated, and the frame 20 is supported on the mobile machine base 12.

Next, the coil 60 is aligned with the slidable tubular member 27 by the lifting device 22 shown in FIG. 1.

Then, the mobile machine base 12 is moved by the motor 13 shown in FIG. 1 and FIG. 8 to an initial position suitable for wrapping a coil of width B and outside diameter D.

In this case, the stroke can be automatically determined by a detector for the end surface of coil attached to the support arm 50.

Next, the grip device 70 for the end of the wrapping paper (FIG. 1 and FIG. 12) is put in the open state. A plurality of support arms 50 are moved toward the center on the disc 40 to impose the pressure $P_1$ on the cylinder 17 (FIG. 7). Next, the frame 20 is shifted to the left (FIG. 1) up to the limit of its stroke.

When the projecting portion of the wrapping paper hangs down particularly far, the support arm 50 can be easily inserted by blowing air into the projecting portion.

Next, the frame 20 is moved to the right (FIG. 1) by the motor 16 with the pressure $P_1$ of the cylinder 17 as a counter balance pressure. At the same time the support arm 50 is made to operatively move with the motor 16 by the motor 29 to shift to the initial folding position (the position of FIG. 1).

Further, the cylinder 76 (FIG. 12) works to grip the edge of the projecting portion of the wrapping paper by the grip device 70 at plural points in the circumferential direction via the rack 59 and pinion 55.

In this case, since the projecting portion of the wrapping paper hangs down somewhat, the grip position in the circumferential direction differs, too.

Therefore, after having gripped the wrapping paper, the grip position is corrected by moving the frame 20 away from the end surface of the coil by the motor 16. This is how the initial positioning for folding the ends is carried out (see FIG. 14-*a*).

When the adjustment of the horizontal position of the frame 20 is completed, the bracket 7-1 is returned to the position shown in FIG. 4.

Next, a suitable back pressure $P_2$ is maintained in the cylinder 17 throughout the folding of the wrapping paper, then the support arms 50 are made to slide from the outer circumference of the coil to its axial center in a squeezing manner on the disc 40 along the guide rails by driving the motor 29.

With the shift movement, tension is generated in the projecting portion of the wrapping paper 61. The back pressure $P_2$ is suitably selected according to the kind of the wrapping material. In addition, the horizontal component which draws the frame 20 to the end surface of the coil varies with the centripetal motion of the support arms 50, and the back pressure $P_2$ is automatically controlled according to the external shape and size of the coil and also in compliance with the preset mode.

The frame 20 is supported on the mobile machine base 12 on the friction bearing. Hence the frame 20 is drawn to the left on the mobile machine base 12 (FIG. 1) by the above tension. In other words, the free edge of the projecting portion of the wrapping paper is restrained by tension throughout the folding operation as it is continuously drawn to the end surface of the coil.

Figure 14:
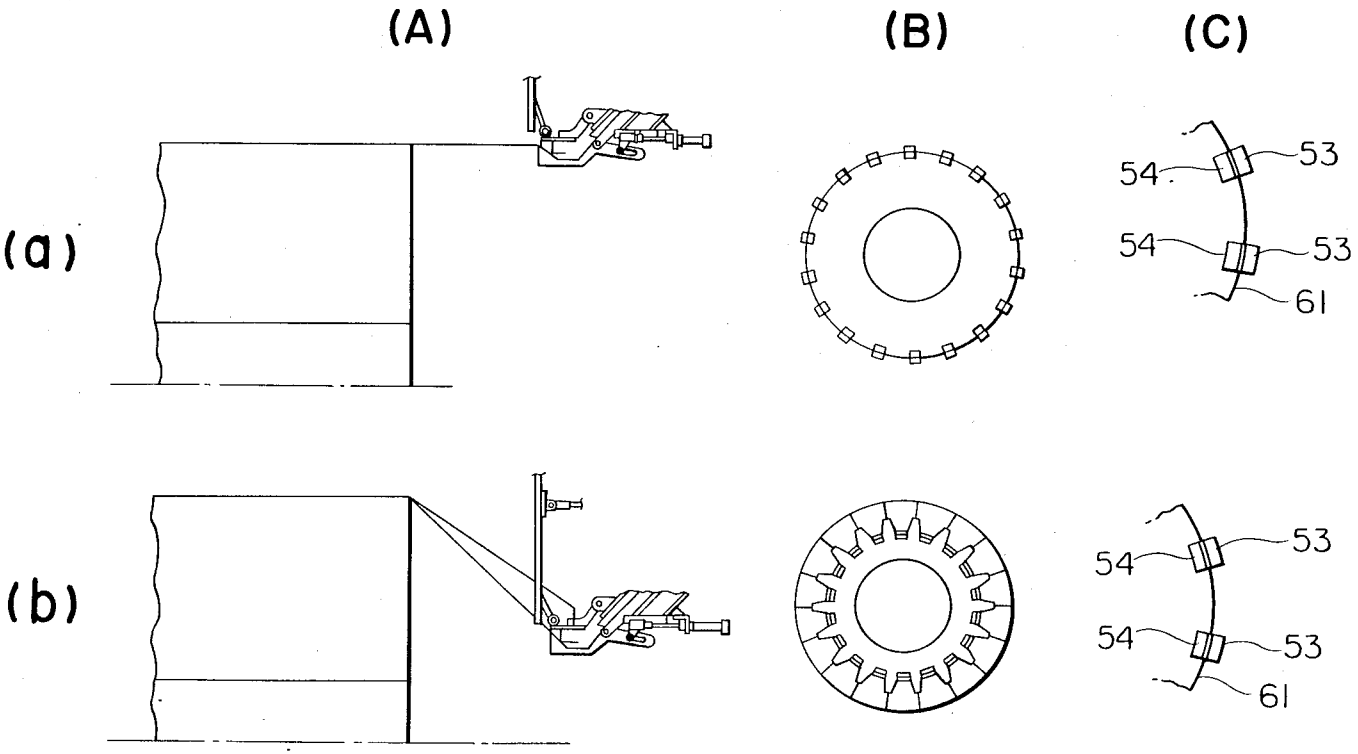
FIG. 14-A is a flow chart of the invention.
Figure 14:
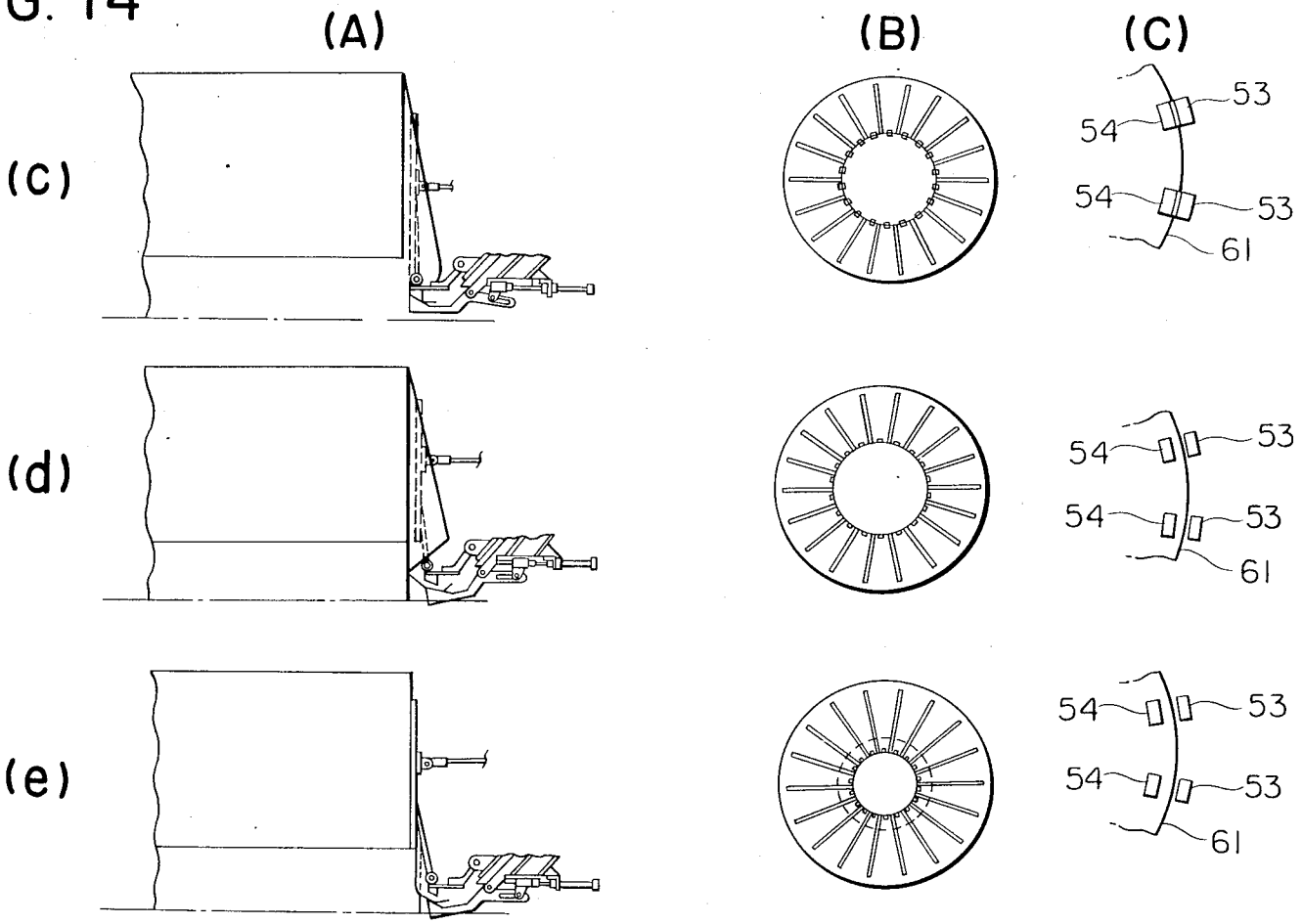

In the course of time, pleats are produced regularly in the wrapping paper in the direction perpendicular to the end surface of the coil (see FIGS. 14, *b* and *c*).

Next, the projecting portion of the wrapping paper is folded up along the locus OQR till $\theta \approx 90°$. Subsequently, the lower member of the grip device 70 for the wrapping paper is rotated counterclockwise by the attaching arm 54-2 for the inner grip member acting as a center fulcrum 74, by the hydraulic cylinder 71, the guide 72 and the link mechanism 73 so as to release the grip (see FIG. 14*d*).

Then, the support arm 50 is further drawn to the axial center of the coil and the pusher plate 52 is pressed to the end surface of the coil by the cylinder 51. The slidable tubular member 27 is rotated on the order of 20°–30° along the end surface of the coil by the hydraulic cylinder 28 via a common mechanism so as to make the pleats bend over (see FIG. 14*e*).

Next, the support arm 50 moves a little in the outer circumferential direction of the coil end surface, whereafter the folded edge of wrapping paper is fixed firmly.

FIG. 14 is a flow chart of the operation of the invention.

In the drawing, (a) refers to the beginning of folding preparation ($\theta=0°$); (b) the intermediate period of folding ($\theta=45°$); (c) immediately before completion of the folding ($\theta=90°$); (d) release of the grip on the wrapping paper ($\theta=90°$); (e) where the support arm approaches in the axial center direction of the coil, and the pusher plate 52 is pressed on the coil end surface by the cylinder 51, and thereafter the disc 40 is rotated by the cylinder 28 to let the pleats fall down. Then, the pressing of the pusher plate is ended, and the support arms 50 are drawn to the center of the coil end surface to avoid the interference with a taping device or eye trumpet and adhesion devices, and thereafter the head 80 is inserted into the coil bore to firmly fix the folded edge of wrapping paper with the tape. Thus, the packaging operation for the end surface of the coil is completed.

Figure 15:
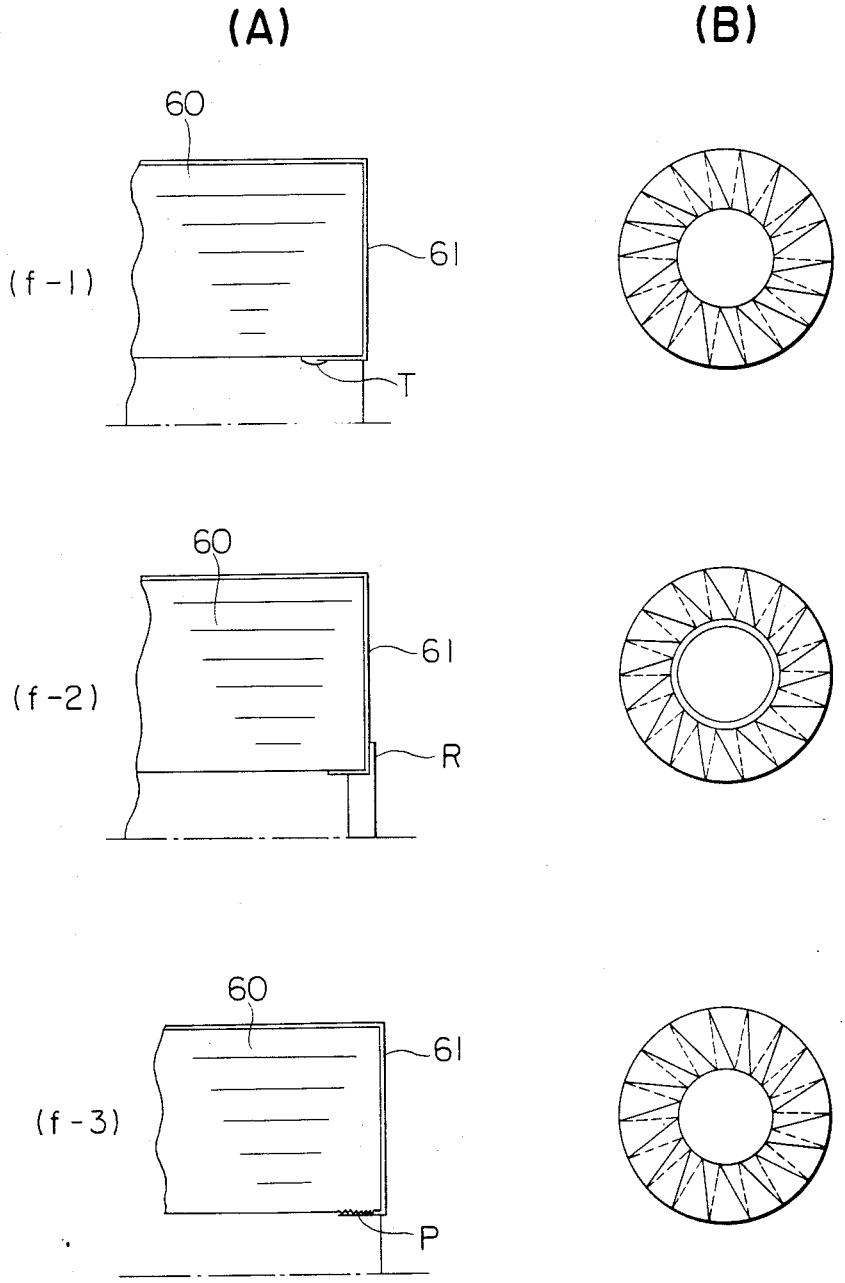
FIG. 15 is an explanatory view showing how the folded edge of a wrapping paper is firmly fixed.

FIG. 15-(*f*-1) illustrates the condition where the wrapping paper is fixed by a tape (T).

FIG. 15-(*f*-2) illustrates the condition where the folded edge of the wrapping paper is fixed by the eye trumpet (R) of the coil bore.

FIG. 15-(*f*-3) depicts the condition where the folded edge of the wrapping paper is fixed by a heat- or pressure-sensitive adhesive (P).

As fully described in the foregoing, the present invention is directed to a novel apparatus for the wrapping the end surface of a cylindrical object with a wrapping material in which a paper folding apparatus mounted frame is drawn toward the coil end surface by a tension which occurs in the projecting portion of the wrapping paper, and the free end of the paper projecting portion is restrained at all times by a suitable tension throughout the course of the folding action. In addition, control of the frame in the horizontal direction during the folding step, which has hitherto been difficult to realize is no longer required. Accordingly, even where the kind of the wrapping paper and the external shape and size of a coil to be wrapped may be varied over wide ranges, according to present invention, the formation of regular pleats can be attained by a relatively simple mechanism and control, and a neat and attractive cylindrical package can be assured.

What is claimed is:

1. Apparatus for wrapping the end surface of a cylindrical object comprising, in combination, an immovable machine base, a mobile machine base on said immovable machine base, the position of said mobile machine base being adjustable in the horizontal direction, a fixing frame on said mobile machine base, an ultra low friction sliding mechanism supporting said fixing frame on said mobile machine base, a mechanism connected to said fixing frame for adjusting the position of said fixing frame in the horizontal direction, said frame being provided with a tubular member which is freely movable in the vertical direction, a lift device connected to said tubular member for moving it vertically, a rotatable tubular member fitted into said tubular member and provided with a drive source for rotation, said rotatable tubular member being further provided with a support arm fixing disc having a plurality of radial elongated openings formed at equal intervals therearound, a support arm base for each opening and shiftable on the disc in the direction of the corresponding opening, each said support arm base freely slidable in a corresponding opening, support arm drive means for driving said support arms radially on said fixing disc, and a support arm pivotally mounted on each said support arm base, said support arm being provided at its free end with a grip device consisting of a radially outer and a radially inner member for gripping the projecting portion of the wrapping paper, said outer member being provided with a pusher plate for being pressed against the end of the coil as said grip device is moved radially inwardly, and means for rotating said pusher plates, whereby a projecting portion of a wrapping paper on the outer surface of the cylindrical object is gripped on its circumference by the grip devices, pleats are formed therein as the support arms are moved inwardly and the free end of the projecting portion of the wrapping paper is constrained under tension, and the folded pleats of the wrapping paper are pressed against the coil upon rotation of said pusher plates.

2. Apparatus as claimed in claim 1 in which the outer and inner members of said grip device have surfaces which are oblique relative to the axial center of the coil at such an angle that they are oblique to the direction from which the paper is held.

3. An apparatus as claimed in claim 2 in which said angle corresponds to the kind of wrapping paper.

* * * * *